US012222143B2

(12) United States Patent
Molavi et al.

(10) Patent No.: US 12,222,143 B2
(45) Date of Patent: Feb. 11, 2025

(54) VAPOR COMPRESSION SYSTEM AND METHOD FOR VAPOR OIL RECOVERY

(71) Applicant: Carrier Corporation, Palm Beach Gardens, FL (US)

(72) Inventors: Anthony S. Molavi, Mooresville, NC (US); Scott T. McDonough, Charlotte, NC (US); William T. Slay, Chickamauga, GA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/301,263

(22) Filed: Mar. 30, 2021

(65) Prior Publication Data

US 2021/0318042 A1 Oct. 14, 2021

Related U.S. Application Data

(60) Provisional application No. 63/006,761, filed on Apr. 8, 2020.

(51) Int. Cl.
*F25B 43/02* (2006.01)
*F25B 13/00* (2006.01)

(52) U.S. Cl.
CPC ..... *F25B 43/02* (2013.01); *F25B 13/00* (2013.01)

(58) Field of Classification Search
CPC ..... F25B 43/02; F25B 13/00
See application file for complete search history.

(56) References Cited

U.S. PATENT DOCUMENTS 5,551,249 A * 9/1996 Van Steenburgh, Jr. ..... F25B 41/20 62/223
10,197,316 B2 2/2019 De Larminat et al.
2013/0139535 A1* 6/2013 Nares ..... F04B 49/00 137/565.11

(Continued)

FOREIGN PATENT DOCUMENTS

JP 2007211645 A 8/2007
WO 2006088459 A2 8/2006

OTHER PUBLICATIONS

Extended European Search Report received for EP Application No. 21167472.6, mailed on Aug. 21, 2023, 7 Pages.

*Primary Examiner* — Larry L Furdge
*Assistant Examiner* — Keith Stanley Myers
(74) *Attorney, Agent, or Firm* — Drew Folgmann

(57) ABSTRACT

A vapor compression system including: a compressor having a compressor suction port and a compressor discharge port configured to circulate a working fluid through a flow circuit; a first heat exchanger operably coupled to the compressor discharge port; a second heat exchanger operably coupled to the compressor suction port; a heat recovery heat exchanger operably coupled to the first and second heat exchangers wherein the heat recovery heat exchanger is configured to: receive the working fluid in a first phase from the first heat exchanger; receive the working fluid in a second phase from the second heat exchanger; exchange heat between the working fluid in the first phase and the second phase; and a bypass valve positioned between the heat recovery heat exchanger discharge and the second heat exchanger and defining a first flow path and a second flow path.

10 Claims, 2 Drawing Sheets

(56) References Cited

U.S. PATENT DOCUMENTS

| | | | | |
|---|---|---|---|---|
| 2014/0174112 | A1* | 6/2014 | Molavi | F25B 43/02 62/84 |
| 2016/0153688 | A1* | 6/2016 | Ronk | F25B 31/002 62/84 |
| 2018/0306472 | A1 | 10/2018 | Molavi | |
| 2019/0242631 | A1 | 8/2019 | Sishtla et al. | |
| 2021/0028692 | A1* | 1/2021 | Green | H02M 1/4225 |

* cited by examiner

VAPOR COMPRESSION SYSTEM AND METHOD FOR VAPOR OIL RECOVERY

CROSS REFERENCE TO A RELATED APPLICATION

The application claims the benefit of U.S. Provisional Application No. 63/006,761 filed Apr. 8, 2020, the contents of which are hereby incorporated in their entirety.

BACKGROUND

This invention relates generally to vapor compression systems, and more particularly to oil reclamation vaporizers for vapor compression systems.

A vapor compression system, including a chiller system, removes heat from a liquid via a vapor compression refrigeration cycle. This liquid can then be circulated through a heat exchanger to cool equipment or may be provided to another process stream. In air conditioning systems, chilled water is typically distributed to heat exchangers or coils in air handling units or other types of terminal devices which cool the air in the respective space(s). The water is then re-circulated back to the chiller to be cooled again. Cooling coils transfer latent and sensible heat from the air to the chilled water, thus cooling and usually dehumidifying the air stream. In industrial applications, chilled water or other liquids from the chiller can be pumped through process or laboratory equipment to cool the laboratory equipment.

In recent years, variable speed drive (VSD) technology has been developed to increase efficiencies of vapor compression chillers, in particular, and chillers are now commonly designed with VSD capability. Such chillers may be referred to as "variable speed chillers" and are able to efficiently match cooling demands of a system in which they are deployed. When applied to a refrigeration compressor, VSD permits continually varying the compressor speed, giving an advantage of smooth operation and better partial-load performance. However, when a compressor operates at a low load and low speed, it may be more difficult to maintain proper oil viscosity making oil recovery more difficult. Maintaining proper oil viscosity is critical to reliable compressor operation. Some systems have addressed this problem by employing a type of bypass which uses copper line and a valve that allows a high pressure vapor (gas) refrigerant/oil mixture to flow from a first heat exchanger, such as a condenser, to a second heat exchanger, such as an evaporator. However, several benefits can be achieved by directing a high pressure, high temperature vapor refrigerant from a condenser to a heat recovery heat exchanger, such as a vaporizer, and then through a controlled bypass port to the evaporator. Benefits may include higher viscosity oil output enabling more compressor speed reduction at varying loads, and increased operating efficiency.

BRIEF DESCRIPTION OF THE INVENTION

According to one non-limiting embodiment, a vapor compression system including: a compressor having a suction port and a discharge port configured to circulate a working fluid through a flow circuit; a first heat exchanger operably coupled to the compressor discharge port; a second heat exchanger operably coupled to the compressor suction port; a heat recovery heat exchanger operably coupled to the second heat exchanger and the first heat exchanger, wherein the heat recovery heat exchanger is configured to: receive the working fluid in a first phase from the first heat exchanger, receive the working fluid in a second phase from the second heat exchanger, and exchange heat between the working fluid in the first phase and the second phase; and a bypass valve positioned between the heat recovery heat exchanger discharge and the second heat exchanger and defining a first flow path and a second flow path.

In addition to one or more of the features described above, or as an alternative, in further embodiments, the vapor compression system wherein the working fluid in the first phase comprises a mixture of vapor refrigerant and oil, and the working fluid in the second phase comprises a mixture of liquid refrigerant and oil.

In addition to one or more of the features described above, or as an alternative, in further embodiments, the vapor compression system wherein the heat recovery heat exchanger has a first portion for receiving the first phase and a second portion for receiving the second phase.

In addition to one or more of the features described above, or as an alternative, in further embodiments, the vapor compression system further comprising a controller in communication with the bypass valve and the compressor, the controller configured to: determine when the compressor is operating below a predetermined operating capacity; open the bypass valve allowing the working fluid in the first phase to flow from the heat recovery heat exchanger through the first flow path and the second flow path, to the second heat exchanger, when the compressor operating load is equal to or less than the predetermined operating capacity; and close the bypass valve allowing the working fluid in the first phase to flow from the heat recovery heat exchanger through the first flow path to the second heat exchanger, when the compressor operating load is greater than the predetermined operating load capacity.

In addition to one or more of the features described above, or as an alternative, in further embodiments, the vapor compression system, wherein the predetermined operating load capacity comprises 25% of the maximum operating load capacity.

According to one non-limiting embodiment, a controller operably coupled to a compressor and a bypass valve, the controller including: a memory configured to store at least one predetermined operating load capacity limit; and a processor operably coupled to the memory, wherein the controller is configured to: receive a signal indicative of a compressor operating load capacity; compare the operating load capacity to at least one signal indicative of at least one of a predetermined compressor operating load capacity limit; and actuate the bypass valve when the operating load capacity is less than the at least one predetermined operating load capacity limit.

In addition to one or more of the features described above, or as an alternative, in further embodiments, the controller, wherein the predetermined operating load capacity limit is equal to or greater than 25% of the compressor maximum operating load capacity.

According to one non-limiting embodiment, a method of operating a vapor compression system, the method including: operating a compressor to direct a working fluid in a first phase through a first heat exchanger and a heat recovery heat exchanger; operating the heat recovery heat exchanger to direct the working fluid in the first phase through at least one of an orifice and a bypass valve; determining whether a compressor operating load is equal to or less than a predetermined operating load capacity; operating a controller to direct the working fluid in the first phase to a second heat exchanger by a first flow path when the compressor operating load is greater than a predetermined operating load capacity; and operating the controller to direct the working fluid in the first phase to the second heat exchanger by the first flow path and a second flow path when the compressor operating load is less than or equal to the predetermined operating load capacity.

In addition to one or more of the features described above, or as an alternative, in further embodiments, the method wherein the predetermined operating load capacity comprises 25% of the maximum operating capacity of the compressor.

In addition to one or more of the features described above, or as an alternative, in further embodiments, the method wherein the compressor includes a screw compressor configured to operate at variable loads.

In addition to one or more of the features described above, or as an alternative, in further embodiments, the method wherein working fluid includes a refrigerant/oil mixture having a first phase and a second phase, wherein, the first phase is a mixture of vapor refrigerant and oil, and the second phase is a mixture of liquid refrigerant and oil.

In addition to one or more of the features described above, or as an alternative, in further embodiments, the method wherein the predetermined operating load capacity is equal to or greater than 25% of the compressor maximum operating load capacity.

BRIEF DESCRIPTION OF THE DRAWINGS

The accompanying drawings form a part of the specification. Throughout the drawings, like reference numbers identify like elements.

These and other advantages and features will become more apparent from the following description taken in conjunction with the drawings.

DETAILED DESCRIPTION OF THE INVENTION

A detailed description of one or more embodiments of the disclosed apparatus and method are presented herein by way of example and not limitation with reference to the Figures.

Figure 1:
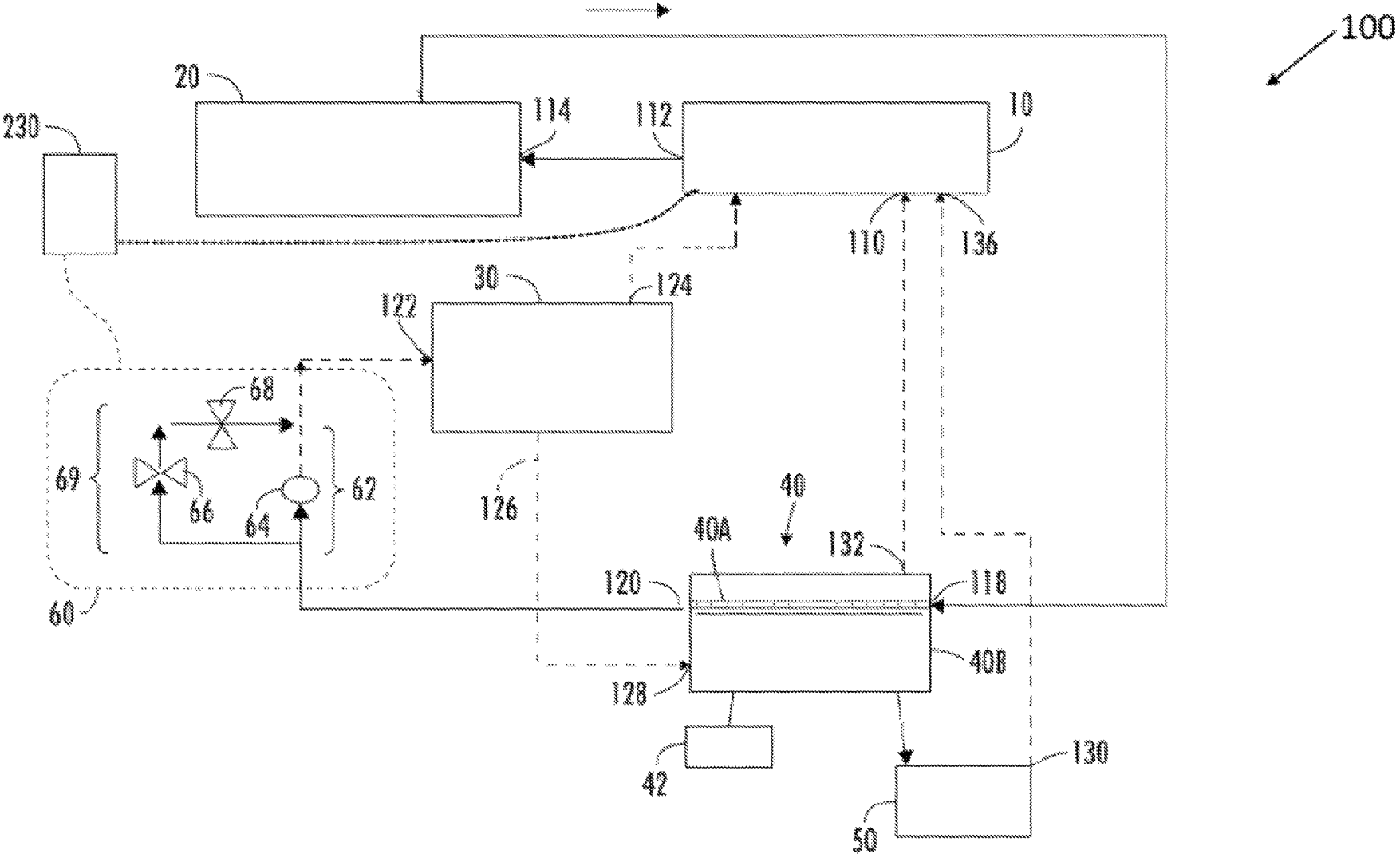
FIG. 1 illustrates a vapor compression system in accordance with embodiments of the disclosure.

FIG. 1 illustrates a vapor compression system 100 in accordance with embodiments of the disclosure. The vapor compression system 100 may include many other conventional features not depicted for simplicity of the drawings. Vapor compression system 100 is directed to refrigeration systems and may include chiller systems, and systems having a multiple stage compressor arrangement. Persons of ordinary skill in this art will readily understand that embodiments and features of this invention are contemplated to include and apply to, not only single stage compressor/chillers, but also to multistage compression chillers.

As shown, vapor compression system 100 includes a compressor 10, a first heat exchanger (e.g., condenser) 20, an expansion valve (not shown), a second heat exchanger (e.g., evaporator or cooler) 30, a heat recovery heat exchanger (e.g., vaporizer) 40, a heater 42, and a sump reservoir 50. Additionally, vapor compression system 100 also includes a controlled bypass system 60 that includes a first flow path 62 that permits a working fluid (e.g., refrigerant) and a non-refrigerant mixture to flow through an orifice 64 under certain operating conditions, and a bypass valve 66, which when actuated by a controller 230 under certain other operating conditions, opens the bypass valve 66 to allow the mixture to flow through a second flow path 69 (which may include one or more check valve 68). The compressor 10, first heat exchanger 20, second heat exchanger 30, heat recovery heat exchanger 40, sump reservoir 50, and the controlled bypass system 60 are serially connected to form a semi- or fully-hermetic, closed-loop refrigeration system.

Vapor compression system 100 may circulate a working fluid to control the temperature in a space such as a room, home, or building. The working fluid may be circulated to absorb and remove heat from the space and may subsequently reject the heat elsewhere. The working fluid may be a refrigerant or a mixture of refrigerant and a non-refrigerant or a blend thereof in gas, liquid or multiple phases. As used herein, the term "first phase" refers to a vapor refrigerant/oil mixture which may be further characterized as a high pressure or low pressure mixture. High pressure flow is represented as a solid line flow path. In addition, the term "second phase" refers to a liquid refrigerant/oil mixture which is generally characterized as a low pressure mixture. Low pressure flow is represented by as a dashed line flow path.

The non-refrigerant may be a lubricant to lubricate mechanical components of the compressor 10. Typically, the non-refrigerant is oil. Accordingly, in the present specification, the non-refrigerant in a liquid phase will be referred to as oil, but embodiments of the invention encompass any other type of non-refrigerant capable of performing the required lubricating functions. As shown in the FIG. 1, the non-refrigerant is generally characterized as a low pressure fluid and is represented as a dashed line flow path from the outlet port 130 of the sump reservoir 50 to the inlet port 136 of the compressor 10.

An exemplary compressor 10 is a screw compressor having a motor (not shown) with the capability to operate at varying speeds (e.g., VSD capability) and thus, the ability to operate under varying load conditions. Alternative compressors 10 are centrifugal compressors, scroll compressors, or reciprocating compressors. A first heat exchanger 20 has a vapor inlet port 114 downstream of compressor discharge port 112. In operation, the compressor 10 compresses the working fluid to drive a recirculating flow of the working fluid through the vapor compression system 100.

First heat exchanger 20 is a heater exchanger that removes heat from the first phase and transfers heat to a second heat transfer liquid (e.g., water or fluid mixture or air) running through the first heat exchanger 20. The first heat exchanger 20 may include a float valve (not shown) which acts as an expansion device. Alternative implementations may include alternate expansion devices.

Downstream of the first heat exchanger 20, is a second heat exchanger 30. The second heat exchanger 30 is used to chill the second heat transfer liquid. For example, the working fluid passing through the second heat exchanger 30 may be in heat exchange relation with water to absorb heat from the water (to cool the water). As with the first heat exchanger 20, the second heat exchanger 30 may represent any appropriate existing or yet-developed configuration. Additional second heat exchanger 30 ports cooperating with the heat recovery heat exchanger 40 and controlled bypass system 60 are discussed below.

An exemplary heat recovery heat exchanger 40 is comprised of a first portion 40A which includes at least one conduit (e.g., one or more tubes or pipes) disposed within a shell referred to as the "second portion" 40B. The first portion 40A is in fluid communication with the compressor 10, the controlled bypass 60 and the second heat exchanger 30. The second portion 40B is in fluid communication with the compressor 10, the second heat exchanger 30, and the sump reservoir 50, each as described below.

The heat recovery heat exchanger 40 first portion 40A receives a high pressure first phase via inlet port 118 from the first heat exchanger 20. The at least one conduit isolates the high pressure first phase from the second phase in the second portion 40B, such that the hot gas within the at least one conduit does not mix with the second phase within the second portion 40B. As the high pressure first phase flows through the first portion 40A, the first phase will immediately begin to be heated and boil and is useful as a supplemental heating source to the second phase that may collect in the second portion 40B, discussed below. The first portion 40A is also in fluid communication with an outlet 120 for discharging the high pressure first phase to the controlled bypass system 60. The high pressure first phase flows through the controlled bypass system 60 where it is converted to a low pressure first phase and flows to the second heat exchanger 30.

A controller (e.g., microprocessor based) 230 may control various operations of the vapor compression system 100, including the compressor 10, the heater 42 (which may be a multi-stage heater), and controlled bypass system 60 (including the bypass valve 66), and may receive input from various sensors and user input devices. The controller 230 may have a memory configured to store at least one predetermined compressor operating load capacity limit or range, and a processor operably coupled to the memory. The controller 230 may be configured to be in communication with the controlled bypass system 60 and the compressor 10. The controller 230 may be further configured to have stored therein, a predetermined compressor operating load capacity. The predetermined compressor operating load capacity may be a maximum or minimum operating load capacity limit or range. The controller 230 may be further configured to have a predetermined compressor operating load capacity limit or range such that the controller 230 actuates (opens) the normally closed bypass valve 66 under certain load operating conditions.

In one non-limiting embodiment, the controller 230 may be configured to receive a signal indicative of a compressor operating load capacity; to compare the compressor operating load capacity to at least one signal indicative of at least one of a predetermined compressor operating load capacity limit; and to actuate the bypass valve 66 if the operating load capacity is less than the at least one predetermined compressor operating load capacity limit.

In one non-limiting embodiment, when the operating load capacity of compressor 10 is equal to or greater than 25% of maximum operating load capacity, the bypass valve 66 remains closed causing the high pressure first phase to flow from the heat recovery heat exchanger 40 first portion 40A along a first flow path 62, and through a flow orifice 64. It will be appreciated that in other embodiments the bypass valve 66 remains closed at an operating load capacity less than 25% of the maximum operating load capacity. The diameter of the flow orifice may vary. In one non-limiting embodiment, the orifice 64 has a diameter equal to or greater than 0.1875 inches and equal to or less than 0.3125 inches. The diameter of the orifice 64 aids in converting the working fluid from a high pressure first phase to a lower pressure first phase.

In another non-limiting embodiment, the controller 230 is configured to actuate (open) the bypass valve 66 upon receiving a signal from the compressor 10 that the operating load capacity of compressor 10 is less than 25% of maximum operating load capacity, allowing the high pressure first phase to flow via the first flow path 62 and a second flow path 69. When the flow from the second flow path 69 converges with the flow from the first flow path 62, the high pressure first phase is converted to a lower pressure first phase and enters the second heat exchanger 30 via inlet port 122 where it is in heat exchange relation with water as discussed above.

It should be apparent that the controlled bypass system 60 and controller 230 may have an alternate configuration or that the bypass valve may be normally open. For example, the controller 230 may be configured to actuate the bypass valve 66 upon receiving a fault signal (e.g., from compressor 10) which may indicate a problem with the compressor 10 or other system failure. In this example, a fail-safe mode may enable low load operation.

In the second heat exchanger 30, the working fluid continues to change phase. Some first phase will separate from the second phase and flow through outlet port 124 to the compressor 10. Some second phase refrigerant flows through outlet port 126 entering the heat recovery heat exchanger second portion 40B via inlet port 128 for separation.

In the heat recovery heat exchanger 40, the low pressure second phase may separate into a vapor portion and an oil portion. The heat exchange between the first phase in the first portion 40A and the second phase in the second portion 40B further aids in vapor separation. The heat from the first portion 40A will cause some liquid refrigerant to boil off, turning it to vapor. Vapor in the second portion 40B will flow through an outlet port 132 and is returned to the compressor 10 via inlet port 110. By configuring the heat recovery heat exchanger 40 to be in a heat exchange relation, the first portion 40A provides supplemental heat to the second portion 40B, thereby reducing the amount of heat that may otherwise be required to heat the second phase as discussed below.

The remaining second phase in the second portion 40B of the heat recovery heat exchanger 40 will continue to undergo separation. Oil may separate from the refrigerant due to differences in specific gravities. In addition, a heater 42 may be applied to the second portion 40B to further aide in separation. The heater 42 may also be in communication with controller 230. For example, the heater 42, configured with a thermal sensor, may be electrically coupled to the controller 230 and the second portion 40B. The controller 230 may be further configured to determine at least one temperature limit or range of the second phase. If the measured temperature of the second phase in the second portion 40B is less than or equal to a predetermined temperature limit or range, the heater 42 may turn on and apply heat until the measured temperature of the second phase is greater than or equal to another predetermined temperature limit or range. Because the thermal energy from the heat exchange provides some heating, the heater 42 may be used less, thereby increasing overall operating efficiencies.

The oil that collects in the second portion 40B is discharged to the sump reservoir 50. Oil in the sump reservoir 50 may be delivered to compressor 10 inlet port 136 via a pump (not shown) to lubricate mechanical components of the compressor 10. After exiting the sump reservoir 50 through outlet port 130, the oil may undergo filtration through a filtration system (not shown) before delivering the oil to compressor 10. The sump reservoir 50 may also include a heating element (e.g., heater 42) configured to heat the oil in the sump reservoir 50 to effectively evaporate any residual refrigerant from the oil and to keep the oil viscous, or to maintain a rich level of viscosity. In the present specification, "rich viscosity" refers to a level of viscosity necessary in oil provided to the compressor 10 or other parts to be lubricated that is sufficient to effectively lubricate the compressor 10 or other parts. In other words, the oil requires a certain minimum thickness or viscosity to be an effective lubricant.

Figure 2:
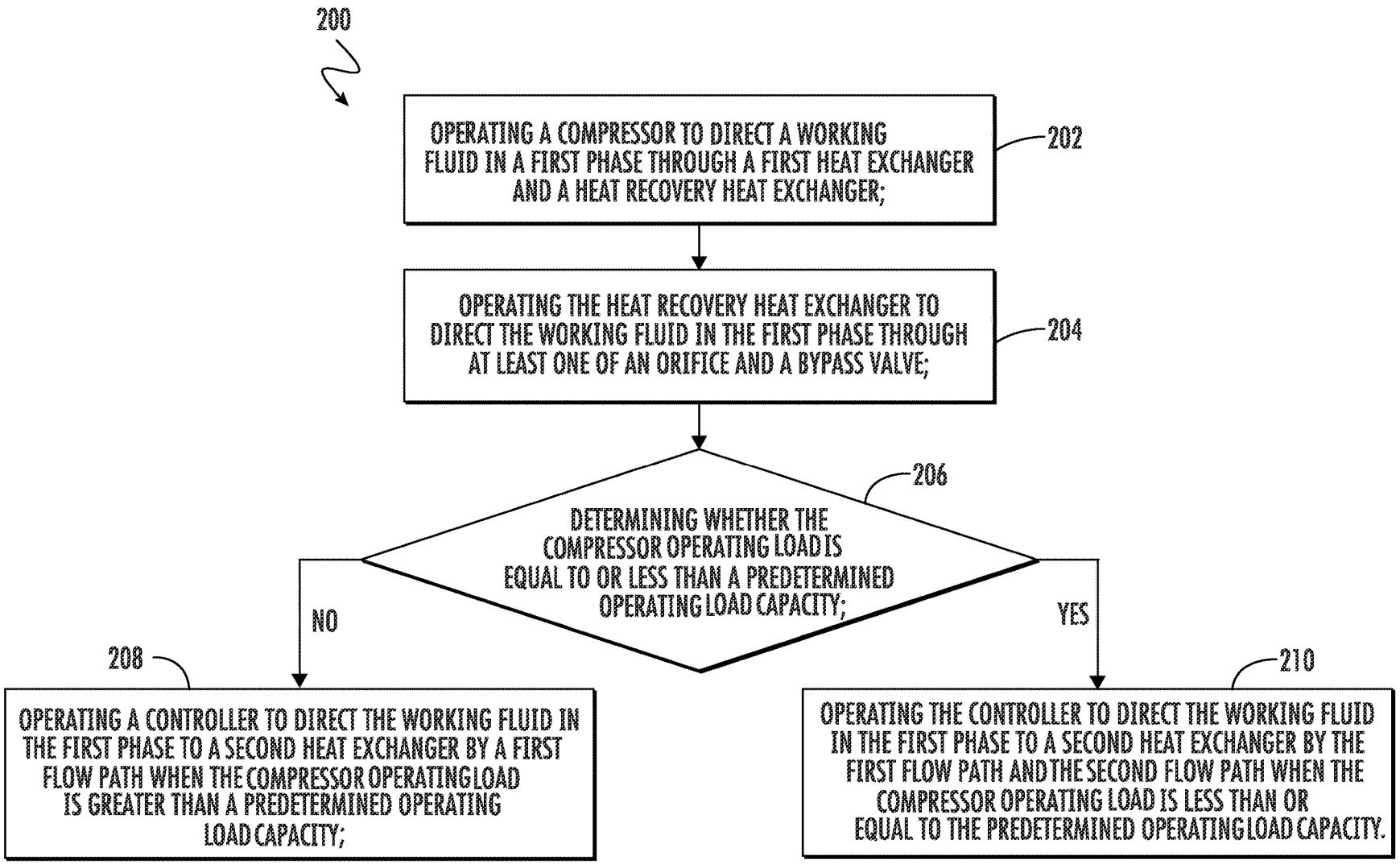
FIG. 2 illustrates a method for operating a vapor compression system in accordance with embodiments of the disclosure.

Referring to FIG. 2, a method for operating vapor compression system in accordance with the embodiments of the disclosure is shown.

The method begins with an operational vapor compression system 100, such as a chiller system. The method begins at 202 with operating a compressor 10 to direct a working fluid (e.g., refrigerant) in a first phase through a first heat exchanger (e.g., condenser) 20 and a heat recovery heat exchanger 40 (e.g., vaporizer). The compressor 10 may include a screw compressor. The compressor 10 may also include single stage compressor/chiller, multi-stage compression chillers and single stage and/or multistage compressor chiller. The method may further include configuring the compressor to operate at variable speeds and loads. For example, the compressor 10 may having a motor (not shown) with the capability to operate at varying speeds (e.g., VSD capability) and thus, the ability to operate under varying load conditions. The "first phase" refers to a vapor refrigerant/oil mixture, while the "second phase" refers to a liquid refrigerant/oil mixture. In addition, the heat recovery heat exchanger 40 may have a first portion 40A and a second portion 40B.

The next step in the method 204 includes operating the heat recovery heat exchanger 40 to direct the working fluid in the first phase through a controlled bypass system 60 having at least one of an orifice 64 and a bypass valve 66, to the second heat exchanger 30. In this step, the first portion 40A of heat recovery heat exchanger 40 receives a first phase from the first heat exchanger 20 through an inlet port 118 and directs the first phase through an outlet port 120 to the controlled bypass system 60. The controlled bypass system 60 includes a first flow path 62 having an orifice 64 through which the first phase may flow; and a second flow path 69 having a normally closed bypass valve 66 which is in communication with a controller 230 configured to open bypass valve 66 under certain operating conditions.

Step 206 includes determining when the compression device 10 is operating below a predetermined operating capacity. In one non-limiting embodiment, the predetermined operating load capacity is 25% of maximum operating load capacity of the compressor 10.

Step 208 includes operating the controller 230 to direct the working fluid in the first phase to a second heat exchanger 30 (e.g., evaporator or cooler) via a first flow path 62 when the compressor 10 operating load capacity is greater than a predetermined operating load capacity. In this step, when the compressor operating load capacity is greater than the predetermined operating load capacity, the controller 230 is configured to take no action, leaving the bypass valve 66 closed until it receives a signal (e.g., from compressor 10) that a predetermined load operating limit has been reached. Until the predetermined load operating limit has been reached, the first phase will flow via the first flow path 62 and through orifice 64 to the second heat exchanger 30.

Step 210 includes operating the controller 230 to direct the working fluid in the first phase to the second heat exchanger 30 by the first flow path 62 and a second flow path 69. In this step, the controller 230 is in electrical communication with the bypass valve 66 and the compressor 10. The controller 230 is configured to have stored therein at least one predetermined compressor 10 operating load limit or range. The controller 230 is further configured to actuate (open) the bypass valve 66 upon receiving a signal (e.g., from compressor 10) that the load operating capacity of the compressor 10 is less than or equal to the predetermined load operating capacity. When the compressor 10 is operating at less than or equal to 25% of the maximum load operating capacity of the compressor 10, the controller 230 operates to open bypass valve 66, and the first phase is allowed to flow through the first flow path 62 and the second flow path 69. It will be appreciated that in other embodiments the controller 230 operates to open the bypass valve 66 when the operating load capacity is greater than 25% of the maximum operating load capacity.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

We claim:

1. A vapor compression system, comprising:

a compressor having a suction port and a discharge port configured to circulate a working fluid through a flow circuit;

a first heat exchanger operably coupled to the compressor discharge port;

a second heat exchanger operably coupled to the compressor suction port;

a heat recovery heat exchanger operably coupled to the second heat exchanger and the first heat exchanger, wherein the heat recovery heat exchanger has a first portion for receiving a first phase and a second portion for receiving a second phase, and the heat recovery heat exchanger is configured to:

receive the working fluid in the first phase from the first heat exchanger, receive the working fluid in the second phase from the second heat exchanger, and exchange heat between the working fluid in the first phase and the second phase;

an orifice and a bypass valve positioned between the heat recovery heat exchanger discharge and the second heat exchanger and defining a first flow path and a second flow path, wherein the heat recovery heat exchanger is located between the first heat exchanger and the second heat exchanger in the flow circuit; and a controller in communication with the bypass valve and the compressor, the controller being configured to:

determine when the compressor is operating below a predetermined operating load capacity;

open the bypass valve allowing the working fluid in the first phase to flow from the first portion of the heat recovery heat exchanger through the first flow path via the orifice and the second flow path via the bypass valve, to the second heat exchanger, when a compressor load is equal to or less than the predetermined operating load capacity; and close the bypass valve allowing the working fluid in the first phase to flow from the first portion of the heat recovery heat exchanger through the first flow path via the orifice to the second heat exchanger, when the compressor load is greater than the predetermined operating load capacity.

2. The vapor compression system of claim 1, wherein the working fluid in the first phase comprises a mixture of vapor refrigerant and oil, and the working fluid in the second phase comprises a mixture of liquid refrigerant and oil.

3. The vapor compression system of claim 1, wherein the predetermined operating load capacity comprises 25% of the maximum operating load capacity.

4. The vapor compression system of claim 1, wherein the controller comprises:

a memory configured to store the predetermined operating load capacity; and a processor operably coupled to the memory, wherein the controller is configured to:

receive a signal indicative of the compressor load; and compare the operating compressor load to at least one signal indicative of the predetermined operating load capacity.

5. The vapor compression system of claim 4, wherein the predetermined operating load capacity is equal to or greater than 25% of the compressor maximum operating load capacity.

6. A method of operating the vapor compression system as described in claim 1, the method comprising:

operating a compressor to direct a working fluid in a first phase through a first heat exchanger and a heat recovery heat exchanger;

operating the heat recovery heat exchanger to direct the working fluid in the first phase through at least one of an orifice and a bypass valve;

determining whether a compressor operating load is equal to or less than a predetermined operating load capacity;

operating a controller to direct the working fluid in the first phase to a second heat exchanger by a first flow path when the compressor operating load is greater than a predetermined operating load capacity; and operating the controller to direct the working fluid in the first phase to the second heat exchanger by the first flow path and a second flow path when the compressor operating load is less than or equal to the predetermined operating load capacity.

7. The method of claim 6, wherein the predetermined operating load capacity comprises 25% of the maximum operating load capacity of the compressor.

8. The method of claim 6, wherein the compressor comprises a screw compressor configured to operate at variable loads.

9. The method of claim 6, wherein working fluid comprises a refrigerant/oil mixture having a first phase and a second phase, wherein, the first phase comprises a mixture of vapor refrigerant and oil, and the second phase comprises a mixture of liquid refrigerant and oil.

10. The method of claim 6, wherein the predetermined operating load capacity is equal to or greater than 25% of the compressor maximum operating load capacity.

* * * * *